US006726579B2

(12) United States Patent
Ohama et al.

(10) Patent No.: US 6,726,579 B2
(45) Date of Patent: Apr. 27, 2004

(54) MULTI-PIECE SOLID GOLF BALL

(75) Inventors: Keiji Ohama, Kobe (JP); Takahiro Sajima, Kobe (JP); Seiichiro Endo, Kobe (JP)

(73) Assignee: Sumitomo Rubber Industries, Ltd., Kobe (JP)

( * ) Notice: Subject to any disclaimer, the term of this patent is extended or adjusted under 35 U.S.C. 154(b) by 0 days.

(21) Appl. No.: 10/284,365

(22) Filed: Oct. 31, 2002

(65) Prior Publication Data

US 2003/0119606 A1 Jun. 26, 2003

(30) Foreign Application Priority Data

Oct. 31, 2001 (JP) ..... 2001-334747

(51) Int. Cl.[7] ..... A63B 37/06
(52) U.S. Cl. ..... 473/374; 473/383
(58) Field of Search ..... 473/367, 368, 473/370, 378, 383, 384, 373, 374

(56) References Cited

U.S. PATENT DOCUMENTS

| | | | | |
|---|---|---|---|---|
| 5,830,085 | A | 11/1998 | Higuchi et al. | |
| 5,911,639 | A | * 6/1999 | Kasashima et al. | 473/377 |
| 6,045,459 | A | 4/2000 | Sugimoto et al. | |
| 6,129,640 | A | 10/2000 | Higuchi et al. | |
| 6,210,292 | B1 | 4/2001 | Higuchi et al. | |
| 6,336,872 | B1 | 1/2002 | Moriyama et al. | |
| 6,336,873 | B1 | 1/2002 | Yamagishi et al. | |

FOREIGN PATENT DOCUMENTS

| | | | |
|---|---|---|---|
| EP | 0 897 732 | A2 | 2/1999 |
| EP | 0 908 199 | A1 | 4/1999 |
| JP | 9-313643 | A | 12/1997 |
| JP | 9-322948 | A | 12/1997 |
| JP | 11-57067 | A1 | 3/1999 |
| JP | 11-114094 | A | 4/1999 |
| JP | 11-253578 | A | 9/1999 |
| JP | 2000-70414 | A | 3/2000 |
| JP | 2000-070408 | A | 3/2000 |
| JP | 2000-070409 | A | 3/2000 |
| JP | 2000-189541 | A | 7/2000 |
| JP | 2000-225209 | A | 8/2000 |
| JP | 2000-296187 | A | 10/2000 |
| JP | 2000-300695 | A | 10/2000 |

* cited by examiner

*Primary Examiner*—Raeann Gorden
(74) *Attorney, Agent, or Firm*—Birch, Stewart, Kolasch & Birch, LLP

(57) ABSTRACT

The present invention provides a multi-piece solid golf ball having soft and good shot feel and excellent flight performance when hit by a golfer who swings a golf club at low head speed. The present invention relates to a multi-piece solid golf ball comprising a core, an intermediate layer and a cover having many dimples on the surface thereof, wherein hardness distribution of the core; hardness distribution between each layer and the contiguous layer in the golf ball; a ratio of a thickness of the cover to that of the intermediate layer; a ratio (X/D) of the total periphery length (X) to a diameter of the golf ball; and a ratio ($V_D/V_G$) of the total volume of the dimples ($V_D$) to a volume of the phantom sphere ($V_G$) assuming that the golf ball is a true sphere having no dimples on the surface thereof; are adjusted to specified ranges.

4 Claims, 5 Drawing Sheets

(2)—a (1)—a (1)−b (2)—a (2)−b

MULTI-PIECE SOLID GOLF BALL

FIELD OF THE INVENTION

The present invention relates to a multi-piece solid golf ball. More particularly, it relates to a multi-piece solid golf ball having soft and good shot feel and excellent flight performance when hit by a golfer who swings a golf club at low head speed.

BACKGROUND OF THE INVENTION

In golf balls commercially selling, there are solid golf balls such as two-piece golf ball, three-piece golf ball and the like, and thread wound golf balls. Recently, the two-piece golf ball and three-piece golf ball, of which flight distance can be improved while maintaining soft and good shot feel at the time of hitting as good as the conventional thread wound golf ball, generally occupy the greater part of the golf ball market. Multi-piece golf balls such as three-piece golf ball have good shot feel while maintaining excellent flight performance, because they can vary hardness distribution and design of golf balls, when compared with the two-piece golf ball.

The multi-piece solid golf balls are obtained by inserting an intermediate layer between the core and the cover layer constituting the two-piece solid golf ball and have been described in Japanese Patent Kokai Publication Nos. 322948/1997, 313643/1997, 57067/1999, 114094/1999, 253578/1999, 70408/2000, 70409/2000, 70414/2000, 189541/2000, 225209/2000, 296187/2000, 300695/2000 and the like. In the golf balls, it has been attempted to compromise the balance of flight performance and shot feel at the time of hitting by adjusting a hardness, hardness distribution and the like of the core, intermediate layer and cover to proper ranges.

In the golf balls described in Japanese Patent Kokai Publication Nos. 322948/1997 and 300695/2000, since the intermediate layer is formed from rubber composition, the durability is poor.

In the golf balls described in Japanese Patent Kokai Publication Nos. 313643/1997 and 296187/2000, since the hardness of the intermediate layer is higher than that of the core, the deformation amount when hit at low head speed is small, and the shot feel is poor.

In the golf balls described in Japanese Patent Kokai Publication Nos. 114094/1999, 253578/1999, 70408/2000, 70409/2000 and 189541/2000, the hardness of the intermediate layer is lower than that of the core. However, in the golf ball described in Japanese Patent Kokai Publication No. 114094/1999, since the thickness of the cover having higher hardness than the intermediate layer is large, the deformation amount at the time of hitting is small, and the shot feel is poor. In the golf ball described in Japanese Patent Kokai Publication No. 253578/1999, since the intermediate layer is formed from polyurethane, the rebound characteristics are poor, which degrades the flight performance. In the golf balls described in Japanese Patent Kokai Publication Nos. 70408/2000 and 70409/2000, since the hardness of the intermediate layer is too low, the rebound characteristics are poor, which degrades the flight performance. In the golf ball described in Japanese Patent Kokai Publication No. 189541/2000, since the hardness difference between the surface and center of the core is too small, the deformation amount at the time of hitting is small, and the shot feel is poor.

A golf ball has many depressions called "dimples" on the surface. The dimples have function to disturb airflow around the golf ball on the fly and to facilitate turbulent transition at boundary layer so as to give rise to turbulent separation, which is called "dimple effect". In the golf ball having aerodynamically excellent dimples, the facilitation of turbulent transition sifts the separation point of air from the golf ball to backward and reduces a drag coefficient. In addition, the facilitation of turbulent transition increases a difference of the separation point between an upper side and a lower side of the golf ball, caused by backspin of the golf ball, and enhances lifting power applied on the golf ball. The flight performance of the golf ball is improved for the reason. The properties of dimples have been variously studied in order to improve the flight performance of the golf ball.

In the golf balls described in Japanese Patent Kokai Publication Nos. 57067/1999, 70414/2000 and 225209/2000 among the golf balls described above, it has been attempted to compromise the balance of flight performance and shot feel at the time of hitting by adjusting properties of dimples, and hardness and hardness distribution of the core, intermediate layer and cover to proper ranges. However, in the golf balls, a correlation between the cover hardness and properties of dimples is not optimized, and there has been no golf balls, of which the balance between flight performance and shot feel at the time of hitting is sufficiently accomplished.

In addition, a main object of the above golf balls has been to improve a structure of the golf ball or flight performance of the hit golf ball. Therefore, there has been no golf ball having excellent flight performance while maintaining good shot feel when hit by a golfer who swings a golf club at low head speed. It has been required to provide golf balls, of which the shot feel and the flight performance are improved still more.

OBJECTS OF THE INVENTION

A main object of the present invention is to provide a multi-piece solid golf ball having soft and good shot feel and excellent flight performance when hit by a golfer who swings a golf club at low head speed.

According to the present invention, the object described above has been accomplished by providing a multi-piece solid golf ball, of which an intermediate layer is placed between a core and a cover, and by adjusting hardness difference between surface hardness and center hardness of the core; a hardness of the intermediate layer; hardness difference between the surface hardness of the core and the hardness of the intermediate layer; a ratio of a thickness of the cover to that of the intermediate layer; and properties of dimples; to specified ranges, thereby providing a multi-piece solid golf ball having soft and good shot feel and excellent flight performance when hit by a golfer who swings a golf club at low head speed.

This object as well as other objects and advantages of the present invention will become apparent to those skilled in the art from the following description with reference to the accompanying drawings.

BRIEF EXPLANATION OF DRAWINGS

The present invention will become more fully understood from the detailed description given hereinbelow and the accompanying drawings which are given by way of illustrating only, and thus are not limitative of the present invention, and wherein.

SUMMARY OF THE INVENTION

Figure 1:
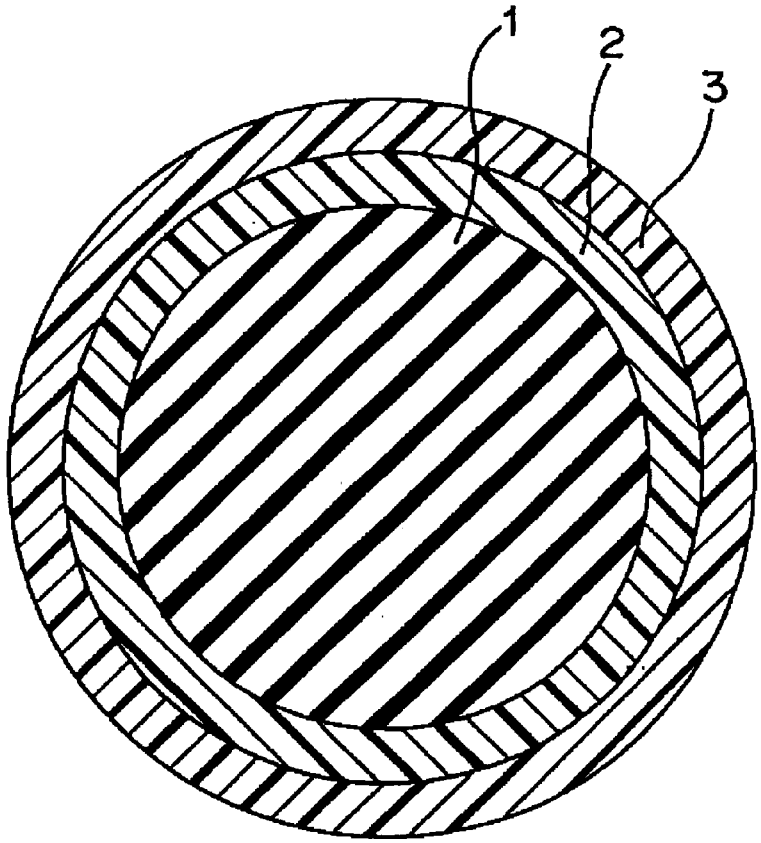
FIG. 1 is a schematic cross section illustrating one embodiment of the golf ball of the present invention.

The present invention provides a multi-piece solid golf ball comprising a core, at least one of an intermediate layer formed on the core and a cover covering the intermediate layer and having many dimples on the surface thereof, wherein

- a hardness difference in JIS-C hardness ($H_S$–$H_C$) between a surface hardness ($H_S$) and a center hardness ($H_C$) of the core is larger than 10,
- a hardness of the intermediate layer is lower than the surface hardness of the core, and the hardness in Shore D hardness of the intermediate layer is higher than 35,
- a ratio ($T_C/T_I$) of a thickness of the cover ($T_C$) to that of the intermediate layer adjacent to the cover ($T_I$) is larger than 0.7 and smaller than 1.2,
- a ratio (X/D) of the total of a periphery length of the dimple (X) to a diameter of the golf ball (D) is within the range of 90.0 to 118.0, and
- a ratio ($V_D/V_G$) of the total volume of the dimples ($V_D$) to a volume of the phantom sphere ($V_G$) assuming that the golf ball is a true sphere having no dimples on the surface thereof is within the range of 0.0108 to 0.0142.

It has been attempted to improve flight performance and shot feel at the time of hitting of the golf ball by adjusting hardness of the core and cover of the golf ball to proper ranges. However, it has not been considered whether the properties of the golf ball are improved also when hit at low head speed. It is difficult for golfers who swing a golf club at low head speed to apply large impact force to golf ball at the time of hitting. Therefore, the present inventors have found that, in order to soften the shot feel while maintaining good rebound characteristics of the golf ball, it is required to harden the outmost layer of the golf ball, and to soften a portion near the surface of the golf ball therein such that it is easy to deform.

The present inventors have studied values of properties of dimples in order to improve the flight performance when hit the golf ball having a structure, of which a portion largely deforms, at relatively low head speed. As a result, the following two indexes have a great effect on aerodynamic properties in arrangement of dimples.

(1) As a value showing a ratio of a volume corresponding to the portion removed from the golf ball by arranging the dimples on the surface of the golf ball (dimple volume) to a volume of the golf ball (phantom sphere) that is a true sphere having no dimples on the surface thereof, a ratio W (=$V_D/V_G$) of the total volume of the dimples ($V_D$) to the volume of the phantom sphere ($V_G$) is an index.

(2) The dimples are formed by removing a portion of the surface of the golf ball from the golf ball, and many depressions are formed on the surface of the golf ball. The depressions disturb an airflow around the golf ball on the fly, that is, turbulence easily occurs at such a position that a shape in section largely changes in an airflow from the spherical surface of the golf ball to the surface of the dimple or from the surface of the dimple to the spherical surface of the golf ball. As a value representing a ratio of a length of the position, that is, edge (periphery) of the dimple, a ratio L (=X/D) of the total of a periphery length of the dimple (X) to a diameter of the golf ball (D) is an index.

In the optimization of properties of dimples of the golf ball, the present inventors have been found that the two indexes have a range of suitable value for hitting by a golfer who swings a golf club at low head speed, and the flight performance of the golf ball can be improved.

In order to put the present invention into a more suitable practical application, it is preferable that

- a base resin of the intermediate layer comprise ionomer resin as a main component, and comprise 5 to 50 parts by weight of thermoplastic elastomer, based on 100 parts by weight of the base resin for the intermediate layer;
- the cover have a hardness in Shore D hardness of higher than 55;
- the dimples have a ratio of the golf ball surface area occupied by the dimple to the total surface area of the golf ball of 0.7 to 0.9; and
- the dimples have a total number of 300 to 500.

DETAILED DESCRIPTION OF THE INVENTION

The multi-piece solid golf ball of the present invention will be explained with reference to the accompanying drawing in detail. FIG. 1 is a schematic cross section illustrating one embodiment of the multi-piece solid golf ball of the present invention. As shown in FIG. 1, the golf ball of the present invention comprises a core 1, at least one of an intermediate layer 2 formed on the core 1, and a cover 3 covering the intermediate layer 2. The intermediate layer may have single-layer structure or multi-layer structure, which has two or more layers. In FIG. 1, in order to explain the golf ball of the present invention simply, a golf ball having one layer of intermediate layer 2, that is, a three-piece solid golf ball will be used hereinafter for explanation. However, the golf ball of the present invention may be also applied for the golf ball having two or more layers of the intermediate layer. The core 1 is obtained by vulcanizing or press-molding the rubber composition using a method and condition, which have been conventionally used for cores of solid golf balls. The rubber composition contains a base rubber, a co-crosslinking agent, a vulcanization initiator, a filler and the like.

The base rubber may be synthetic rubber, which has been conventionally used for cores of solid golf balls. Preferred is high-cis polybutadiene rubber containing a cis-1, 4 bond of not less than 40%, preferably not less than 80%. The high-cis polybutadiene rubber may be optionally mixed with natural rubber, polyisoprene rubber, styrene-butadiene rubber, ethylene-propylene-diene rubber (EPDM) and the like.

The co-crosslinking agent can be α,β-unsaturated carboxylic acids having 3 to 8 carbon atoms (e.g. acrylic acid, methacrylic acid, etc.) or a metal salt thereof, including mono or divalent metal salts, such as zinc, magnesium, or calcium salts; or mixtures thereof and the like. The preferred co-crosslinking agent is zinc acrylate or zinc methacrylate because it imparts high rebound characteristics to the resulting golf ball. The amount of the co-crosslinking agent is from 10 to 50 parts by weight, preferably from 10 to 45 parts by weight, more preferably from 15 to 45 parts by weight, based on 100 parts by weight of the base rubber. When the amount of the co-crosslinking agent is smaller than 10 parts by weight, the vulcanization is not sufficiently conducted, and the core is too soft. Therefore, the rebound characteristics are degraded, which reduces the flight distance. On the other hand, when the amount of the co-crosslinking agent is larger than 50 parts by weight, the resulting golf ball is too hard, and the shot feel is poor.

The vulcanization initiator includes an organic peroxide, such as dicumyl peroxide, 1,1-bis(t-butylperoxy)-3,3,5-trimethylcyclohexane, 2,5-dimethyl-2,5-di(t-butylperoxy) hexane, di-t-butyl peroxide and the like. The preferred vulcanization initiator is dicumyl peroxide. The amount of the vulcanization initiator is from 0.1 to 3.0 parts by weight, preferably 0.3 to 3.0 parts by weight, more preferably 0.5 to 2.5 parts by weight, based on 100 parts by weight of the base rubber. When the amount of the vulcanization initiator is smaller than 0.1 parts by weight, the core is too soft, and the rebound characteristics of the resulting golf ball are degraded, which reduces the flight distance. On the other hand, when the amount of the organic peroxide is larger than 3.0 parts by weight, the core is too hard, and the shot feel of the resulting golf ball is poor.

The filler, which can be typically used for the core of solid golf ball, includes for example, inorganic filler (such as zinc oxide, barium sulfate, calcium carbonate and the like), high specific gravity metal powder filler (such as tungsten powder, molybdenum powder and the like), and the mixture thereof. The amount of the filler is not limited and can vary depending on the specific gravity and size of the cover and core, but is from 5 to 50 parts by weight, based on 100 parts by weight of the base rubber.

The rubber compositions for the core 1 of the golf ball of the present invention can contain other components, which have been conventionally used for preparing the core of solid golf balls, such as antioxidant or peptizing agent.

The core 1 used for the golf ball of the present invention can be obtained by vulcanizing and press-molding the above rubber composition in a mold. The vulcanization, of which the condition is not limited, is conducted at 140 to 180° C. and 2.8 to 9.8 MPa for 10 to 60 minutes. In order to increase the hardness difference in the core, it is desired to vulcanize the core at as high temperature as possible. If dicumyl peroxide as a vulcanization initiator is used, it is preferable to vulcanize the core at the temperature of not less than 160° C.

In the golf ball of the present invention, it is suitable for the core 1 to have a diameter of 30 to 41 mm, preferably 32 to 40 mm, more preferably 36 to 40 mm. When the diameter of the core 1 is smaller than 30 mm, the intermediate layer and cover are thick, and the technical effects accomplished by the presence of the core are not sufficiently obtained. On the other hand, when the diameter is larger than 41 mm, the thickness of the intermediate layer and that of the cover are too small, and the technical effects accomplished by the presence of the intermediate layer and cover are not sufficiently obtained.

In the golf ball of the present invention, it is required for the core 1 to have a hardness difference in JIS-C hardness ($H_S$–$H_C$) between a surface hardness ($H_S$) and a center hardness ($H_C$) of larger than 10, preferably larger than 10 to smaller than 30, more preferably 12 to 25. When the hardness difference is not more than 10, the deformation amount at the time of hitting is small, and the shot feel is poor.

In the golf ball of the present invention, it is desired for the core 1 to have the surface hardness ($H_S$) in JIS-C hardness of 60 to 90, preferably 60 to 85, more preferably 65 to 80. When the surface hardness is lower than 60, the core is too soft, and the rebound characteristics of the resulting golf ball are degraded, which reduces the flight distance. On the other hand, when the surface hardness is higher than 90, the core is too hard, and the shot feel of the resulting golf ball is poor.

In the golf ball of the present invention, it is desired for the core 1 to have the center hardness ($H_C$) in JIS-C hardness of 45 to 75, preferably 50 to 70, more preferably 50 to 65. When the center hardness is lower than 45, the core is too soft, and the rebound characteristics of the resulting golf ball are degraded, which reduces the flight distance. In addition, the shot feel is heavy and poor. On the other hand, when the center hardness is higher than 75, high launch angle at the time of hitting is not sufficiently obtained, which reduces the flight distance.

The term "surface hardness of the core ($H_S$)" as used herein refers to the hardness, which is determined by measuring a JIS-C hardness at the surface of the resulting core. The term "center hardness of the core ($H_C$)" as used herein refers to the hardness, which is determined by cutting the resulting core into two equal parts and then measuring a JIS-C hardness at its center point in section.

In the golf ball of the present invention, it is 0desired for the core 1 to have a deformation amount when applying from an initial load of 98 N to a final load of 1275 N of 3.0 to 6.0 mm, preferably 3.5 to 5.5 mm, more preferably 4.0 to 5.0 mm. When the deformation amount of the core is smaller than 3.0 mm, the core is too hard, and it is difficult for the core to deform at the time of hitting, which degrades the shot feel of the resulting golf ball. In addition, the launch angle is low and the spin amount is large, and the flight performance is degraded. On the other hand, when the deformation amount is larger than 6.0 mm, the core is too soft and excessively deforms, and the rebound characteristics are degraded, which reduces the flight distance. The intermediate layer 2 is then formed on the core 1.

The intermediate layer 2 of the present invention contains thermoplastic resin, particularly ionomer resin, which has been conventionally used for the cover of golf balls, as a base resin. The ionomer resin may be a copolymer of α-olefin and α,β-unsaturated carboxylic acid, of which a portion of carboxylic acid groups is neutralized with metal ion, or a terpolymer of α-olefin, α,β-unsaturated carboxylic acid and α,β-unsaturated carboxylic acid ester, of which a portion of carboxylic acid groups is neutralized with metal ion. Examples of the α-olefins in the ionomer preferably include ethylene, propylene and the like. Examples of the α,β-unsaturated carboxylic acid in the ionomer include acrylic acid, methacrylic acid, fumaric acid, maleic acid, crotonic acid and the like, preferred are acrylic acid and methacrylic acid. Examples of the α,β-unsaturated carboxylic acid ester in the ionomer include methyl ester, ethyl ester, propyl ester, n-butyl ester and isobutyl ester of acrylic acid, methacrylic acid, fumaric acid, maleic acid, crotonic acid and the like. Preferred are acrylic acid esters and methacrylic acid esters. The metal ion which neutralizes a portion of carboxylic acid groups of the copolymer or terpolymer includes a sodium ion, a potassium ion, a lithium ion, a magnesium ion, a calcium ion, a zinc ion, barium ion, an aluminum, a tin ion, a zirconium ion, a cadmium ion and the like. Preferred are sodium ions, zinc ions, lithium ions, magnesium ions and the like, in view of rebound characteristics, durability and the like.

The ionomer resin is not limited, but examples thereof will be shown by a trade name thereof. Examples of the ionomer resins, which are commercially available from Du Pont-Mitsui Polychemicals Co., Ltd. include Hi-milan 1555, Hi-milan 1557, Hi-milan 1601, Hi-milan 1605, Hi-milan 1652, Hi-milan 1705, Hi-milan 1706, Hi-milan 1707, Hi-milan 1855, Hi-milan 1856 and the like. Examples of the ionomer resins, which are commercially available from Du Pont Co., include Surlyn 8945, Surlyn 9945, Surlyn 6320, Surlyn 8320, Surlyn 9320 and the like. Examples of the ionomer resins, which are commercially available from Exxon Chemical Co., include Iotek 7010, Iotek 8000 and the like. These ionomer resins may be used alone or in combination.

As the materials suitably used in the intermediate layer 2 of the present invention, the above ionomer resin may be used alone, but the ionomer resin may be used in combination with at least one of thermoplastic elastomer and the like. Examples of the thermoplastic elastomers, which are commercially available, include polyamide-based thermoplastic elastomer, which is commercially available from Toray Co., Ltd. under the trade name of "Pebax" (such as "Pebax 2533"); polyester-based thermoplastic elastomer, which is commercially available from Toray-Do Pont Co., Ltd. under the trade name of "Hytrel" (such as "Hytrel 3548", "Hytrel 4047"); polyurethane-based thermoplastic elastomer, which is commercially available from BASF Polyurethane Elastomers Co., Ltd. under the trade name of "Elastollan" (such as "Elastollan ET880"); polyurethane-based thermoplastic elastomer, which is commercially available from Dainippon Ink & Chemicals Inc., Ltd. under the trade name of "Pandex" (such as "Pandex T-8180"); styrene-based thermoplastic elastomer, which is commercially available from Mitsubishi Chemical Co., Ltd. under the trade name of "Rabalon" (such as "Rabalon SR04); and the like. Preferred are polyester-based thermoplastic elastomer or styrene-based thermoplastic elastomer, in view of rebound characteristics.

In the golf ball of the present invention, it is desired for a base resin of the intermediate layer to contain a combination of at least one of the above thermoplastic elastomer and at least one of the above ionomer resin. As the amount of both the ionomer resin and thermoplastic elastomer, it is desired for a weight ratio of the ionomer resin to the thermoplastic elastomer to be within the range of 50/50 to 95/5, preferably 52/48 to 85/15, more preferably 55/45 to 80/20. That is, a base resin of the intermediate layer 2 comprises ionomer resin as a main component, and comprises 5 to 50 parts by weight of thermoplastic elastomer, based on 100 parts by weight of the base resin for the intermediate layer. When the amount of the thermoplastic elastomer is smaller than 5 parts by weight, based on 100 parts by weight of the base resin for the intermediate layer, the intermediate layer is too hard, and the shot feel is poor. On the other hand, when the amount of the thermoplastic elastomer is larger than 50 parts by weight and the amount of the ionomer resin is smaller than 50 parts by weight, the intermediate layer is too soft, and the rebound characteristics are degraded, which reduces the flight distance.

In the golf ball of the present invention, the resin composition for the intermediate layer 2 may optionally contain a filler and the like in addition to the base resin. Examples of the fillers include inorganic filler (such as zinc oxide, barium sulfate, calcium carbonate and the like), high specific gravity metal powder filler (such as tungsten powder, molybdenum powder and the like), and the mixture thereof.

The intermediate layer 2 of the present invention may be formed by conventional methods, which have been known to the art and used for forming the cover of the golf balls. For example, there can be used a method comprising molding the intermediate layer composition into a semi-spherical half-shell, then covering the core with the two half-shells, followed by pressure molding, or a method comprising injection molding the composition for the intermediate layer directly on the core to cover it.

In the golf ball of the present invention, it is required for the intermediate layer 2 to have a hardness ($H_M$) in Shore D hardness of higher than 35, preferably higher than 35 to lower than 50, more preferably higher than 37 to lower than 45. When the hardness is not more than 35, the intermediate layer is too soft, and the rebound characteristics of the resulting golf ball are degraded, which degrades the flight performance.

In the golf ball of the present invention, it is required that a hardness of the intermediate layer ($H_M$) be lower than the surface hardness of the core ($H_S$), and the hardness difference ($H_S$–$H_M$) be within the range of preferably 1 to 20, preferably 3 to 15. When the hardness difference ($H_S$–$H_M$) is smaller than 0, that is, the $H_M$ is higher than the $H_S$, the resulting golf ball is hard and it is difficult to deform, and the shot feel is hard and poor.

In the golf ball of the present invention, it is desired for the intermediate layer 2 to have a thickness of 1.0 to 2.5 mm, preferably 1.3 to 2.3 mm, more preferably 1.5 to 2.0 mm. When the thickness of the intermediate layer is smaller than 1.0 mm, the intermediate layer is too thin, and the technical effects accomplished by the presence of the intermediate layer are not sufficiently obtained, and the shot feel is poor. In addition, it is difficult to injection mold, and the productivity is degraded. On the other hand, when the thickness is larger than 2.5 mm, the technical effects accomplished by the presence of the core are not sufficiently obtained, and the rebound characteristics are degraded, which degrades the flight performance. The cover 3 is then formed on the intermediate layer 2.

In the golf ball of the present invention, the cover 3 may comprises thermoplastic resins, such as particularly the ionomer resin, which is the same as used for the intermediate layer 2, or mixtures thereof. As the materials suitably used in the cover 3 of the present invention, the above ionomer resin may be used alone, but the ionomer resin may be used in combination with at least one of the thermoplastic elastomers, which are the same as used in the intermediate layer 2.

In the golf ball of the present invention, the cover composition may optionally contain fillers such as barium sulfate, pigments such as titanium dioxide, and other additives (such as a dispersant, an antioxidant, a UV absorber, a photostabilizer and a fluorescent agent or a fluorescent brightener, etc.), in addition to the resin component as a main component, as long as the addition of the additive does not deteriorate the desired performance of the golf ball cover. If used, the amount of the pigment is preferably 0.1 to 5.0 parts by weight, based on the 100 parts by weight of the base resin of the cover.

In the golf ball of the present invention, the cover 3 may be formed by the same methods as used in the intermediate layer 2.

In the golf ball of the present invention, it is required for a ratio ($T_C/T_I$) of a thickness of the cover ($T_C$) to that of the intermediate layer adjacent to the cover ($T_I$) to be larger than 0.7 to smaller than 1.2, preferably not less than 0.75 to smaller than 1.1, more preferably not less than 0.8 to smaller than 1.05. When the ratio is not more than 0.7, the thickness of the cover is small for the thickness of the intermediate layer, and the technical effects accomplished by the presence of the cover are not sufficiently obtained, which degrades the rebound characteristics and durability of the resulting golf ball. On the other hand, when the ratio is not less than 1.2, the thickness of the intermediate layer is too small, and the technical effects accomplished by the presence of the intermediate layer are not sufficiently obtained, which degrades the shot feel of the resulting golf ball is poor. If the intermediate layer has multi-layer structure, which has two or more layers, it is desired that the thickness of the outmost layer of the intermediate layer adjacent to the cover satisfy the above correlation.

In the golf ball of the present invention, it is desired for the cover 3 to have a thickness of 1.0 to 2.5 mm, preferably 1.3 to 2.3 mm, more preferably 1.5 to 2.0 mm. When the thickness of the cover is smaller than 1.0 mm, the technical effects accomplished by the presence of the cover are not sufficiently obtained, and the rebound characteristics are degraded, which degrades the flight performance, or the durability is poor. In addition, it is difficult to injection mold, and the productivity is degraded. On the other hand, when the thickness is larger than 2.5 mm, the technical effects accomplished by the presence of the core and intermediate layer are not sufficiently obtained, and the resulting golf ball is too hard, which degrades the shot feel.

In the golf ball of the present invention, it is desired for the cover 3 to have a hardness in Shore D hardness of higher than 55, preferably 57 to 70, more preferably 59 to 67. When the hardness is not more than 55, the deformation of the surface of the resulting golf ball is large independently of adjusting the hardness of the core, and the shot feel is heavy and poor such that the rebound characteristics are poor. The term "a hardness of the intermediate layer and cover" as used herein refers to the hardness, which is determined by measuring a hardness using a sample of a stack of the three or more heat and press molded sheets having a thickness of about 2 mm from the intermediate layer composition and cover composition, which had been stored at 23° C. for 2 weeks.

At the time of molding the cover, many depressions called "dimples" are formed on the surface of the golf ball. In the golf ball of the present invention, it is required for a ratio L (=X/D) of the total of a periphery length of the dimple (X) to a diameter of the golf ball (D) to be within the range of 90.0 to 118.0, preferably 98.0 to 115.0, more preferably 105.0 to 112.5. When the ratio L is smaller than 90.0, large changing of airflow around the golf ball on the fly is difficult to occur, the technical effects of improving the flight performance are not sufficiently obtained. On the other hand, when the ratio L is larger than 118.0, large changing of airflow around the golf ball on the fly excessively occurs to break symmetry of the airflow on the fly, and the technical effects of improving the flight performance are not sufficiently obtained.

In the golf ball of the present invention, it is desired for the total of a periphery length of the dimple (X) to be within the range of 4,000 to 5,000 mm, preferably 4,200 to 4,900 mm, more preferably 4,500 to 4,800 mm. When the X is smaller than 4,000 mm, the dimples having sufficient number to improve the flight performance are not arranged on the golf ball. On the other hand, when the X is larger than 5,000 mm, the area of the portion occupied by the depression on the surface of the golf ball is larger than the area of the portion other than it, and symmetry of the airflow around the golf ball on the fly is broken. The term "the total of a periphery length of the dimple (X)" as used herein refers to the total of the length (x) of a periphery (edge of the dimple) formed by arranging the dimple. The periphery length of the dimple (x) is determined by measuring a length along the periphery of the dimple. For example, when the plane shape of the dimple is triangle, the total of lengths of three sides of the triangle is the periphery length (x). Since the side is present on spherical surface, the side, which is strictly not straight line, is an arc. The length of the arc is the length of the side. The periphery length (x) of the circular dimple having a diameter (d) is determined by the calculation using the following formula:

$$x=d\Pi$$

In the golf ball of the present invention, when a volume of the phantom sphere assuming that the golf ball is a true sphere having no dimples on the surface thereof is represented by $V_G$, it is required for a ratio W ($=V_D/V_G$) of the total volume of the dimples ($V_D$) to the volume of the phantom sphere ($V_G$) to be within the range of 0.0108 to 0.0142, preferably 0.0115 to 0.0137, more preferably 0.0120 to 0.0128. In the golf ball having depressions on the surface thereof, when compared with the golf ball having no depressions, the lifting power is improved, which increases the flight distance. However, since the ratio W has the optimum value, a balance between the lifting power and drag is lost when the ratio W is smaller than the desired value, and the hit golf ball creates blown-up trajectory. When the W is smaller than 0.0108, the volume removed from the golf ball as the dimple is too small, that is, depressions are not sufficiently formed on the surface of the golf ball. Therefor, the hit golf ball creates blown-up trajectory, which reduces the flight distance, when hit by a golfer who swings a golf club at low head speed. On the other hand, when the ratio W is larger than 0.0142, a balance between lifting power and drag is lost, and the hit golf ball has low trajectory, which reduces the flight distance (carry), particularly when hit by a golfer who swings a golf club at low head speed.

In the golf ball of the present invention, it is desired for the total volume of the dimples ($V_D$) to be within the range of 400 to 600 $mm^3$, preferably 420 to 580 $mm^3$, more preferably 430 to 570 $mm^3$. When the total volume of the dimple is smaller than 400 $mm^3$, the technical effects accomplished by the presence of the dimples are not sufficiently obtained, which degrades the flight performance. On the other hand, when the total dimple volume is larger than 600 $mm^3$, the trajectory of the hit golf ball is too low, which degrades the flight performance. The term "total volume of the dimples ($V_D$)" refers to the sum of a volume of a dimple space corresponding to the portion removed from the golf ball by arranging the dimple on the surface of the golf ball.

It is desired for the dimples to be of not less than 2 types, preferably 2 to 10 types, which have different diameter or depth. The wording "the dimples have different diameter" as used herein means that the dimples have different diameter by not less than 0.15 mm, and the wording "the dimples have different depth" as used herein means that the dimples have different depth by not less than 0.005 mm. When the dimples are of one type, that is, the dimples have all the same diameter, it is difficult to disturb an airflow around the golf ball on the fly, which degrades its flight performance. It is desired for the dimple to have a diameter of 2.0 to 6.0 mm, preferably 2.2 to 5.5 mm, more preferably 2.3 to 5.0 mm. When the diameter of the dimple is smaller than 2.0 mm, an area of an opening of the dimple is too small, and the technical effects accomplished by the presence of the dimple are not sufficiently obtained. On the other hand, when the diameter of the dimple is larger than 6.0 mm, a number of the dimple arranged on the surface of the golf ball is small, and the technical effects accomplished by the presence of the dimple are not sufficiently obtained. It is desired for the dimple to have a depth of 0.10 to 0.40 mm, preferably 0.12 to 0.35 mm, more preferably 0.13 to 0.33 mm. The term "depth of the dimple" refers to a depth of the dimple from the spherical surface of the golf ball, that is, a distance from the surface of the phantom sphere assuming that the golf ball is a true sphere having no dimples on the surface thereof to the bottom portion of a concave of the dimple. When the depth of the dimple is smaller than 0.10 mm, the distance from the spherical surface to the bottom portion of a concave of the dimple is small, the technical effects of disturbing an airflow around the hit golf ball are nor sufficiently obtained. On the other hand, when the depth of the dimple is larger than 0.40 mm, it is easy to put a dust in the dimple during round game, and the flight performance and rolling performance are degraded.

It is desired for the ratio of the golf ball surface area occupied by the dimple to the total surface area of the golf ball to be within the range of 0.7 to 0.9, preferably 0.72 to 0.86, more preferably 0.75 to 0.83. When the ratio is smaller than 0.7, the technical effects accomplished by the presence of the dimples are not sufficiently obtained, and the flight performance is degraded. On the other hand, when the ratio is larger than 0.9, the area of a land portion (a portion having no dimples on the surface of the golf ball) is too small, and it is difficult for the golf ball to have a spherical shape, which degrades the flight performance and rolling performance. The term "a ratio of the golf ball surface area occupied by the dimple" refers to a ratio of (the sum of an area of a spherical surface corresponding to the portion removed from the golf ball by arranging the dimple on the surface of the golf ball) to (the surface area of the golf ball) assuming that the golf ball is a true sphere having no dimples on the surface thereof.

It is desired for the dimple to have a total number of 300 to 500, preferably 320 to 440, more preferably 360 to 440. When the total number of the dimples is smaller than 300, it is difficult for the golf ball to have approximately spherical shape while maintaining the desired ratio of the golf ball surface area occupied by the dimple described above, that is, it is difficult to maintain smoothness of the surface of the golf ball. On the other hand, when the total number of the dimples is larger than 500, each dimple is small, and the technical effects of disturbing an airflow around the golf ball on the fly are not sufficiently obtained, which degrades the flight performance.

In the golf ball of the present invention, the periphery shape of the dimple is typically circular, but may be non-circular (such as oval) as long as the dimple satisfies the above values of the properties of the dimple. When the dimple is circular, it may be single radius, double radius, or combination thereof.

The ratio of the golf ball surface area occupied by the dimple, the total of the periphery length and the total volume of the dimples as used herein are determined by measuring at the surface of the resulting golf ball, and if paint is applied on the cover, they are determined by measuring at the surface of the applied golf ball.

In the golf ball of the present invention, furthermore, paint finishing or marking with a stamp may be provided after the cover is molded for commercial purposes. The golf ball of the present invention is formed to a diameter of at least 42.67 mm (preferably 42.67 to 42.82 mm) and a weight of not more than 45.93 g, in accordance with the regulations for golf balls.

The diameter of golf balls is limited to not less than 42.67 mm in accordance with the regulations for golf balls as described above. Generally, when the diameter of the golf ball is large, air resistance of the golf ball on the fly is large, which reduces the flight distance. Therefore, most of golf balls commercially available are designed to have a diameter of 42.67 to 42.82 mm. The present invention is applicable to the golf balls having the diameter. There are golf balls having large diameter in order to improve the easiness of hitting. In addition, there are cases where golf balls having a diameter out of the regulations for golf balls are required depending on the demand and object of users. Therefore, it can be considered for golf balls to have a diameter of 42 to 44 mm, more widely 40 to 45 mm. The present invention is also applicable to the golf balls having the diameter.

EXAMPLES

The following Examples and Comparative Examples further illustrate the present invention in detail but are not to be construed to limit the scope of the present invention.

Production of Core

The rubber compositions for the core having the formulation shown in Table 1 were mixed with a mixing roll, and then vulcanized by press-molding in the mold at the vulcanization condition shown in the same Table to obtain spherical cores having a diameter of 35.9 mm. The deformation amount, center hardness ($H_C$) and surface hardness ($H_S$) of the resulting cores were measured. The results are shown in Table 3 (Examples) and Table 4 (Comparative Examples). The difference between the surface hardness ($H_S$) and the center hardness ($H_C$) of the core was determined by calculating from the above values of the hardness, and the result is shown as a hardness difference ($H_S$–$H_C$) in the same Tables. The surface hardness of the core ($H_S$) is shown as the hardness in both JIS-C hardness and Shore D hardness. The test methods are described later.

TABLE 1

(parts by weight)

| Core composition | | I | II | III |
|---|---|---|---|---|
| BR-11 *1 | | 100 | 100 | 100 |
| Zinc acrylate | | 26 | 24.5 | 25 |
| Zinc oxide | | 20 | 20 | 20 |
| Dicumyl peroxide | | 0.9 | 0.9 | 0.9 |
| Diphenyl disulfide | | 0.5 | 0.5 | 0.5 |
| Barium sulfate (*) | | Proper amount | Proper amount | Proper amount |
| Vulcanization condition | Temp (° C.) | 165 | 165 | 144 |
| | Time (min) | 25 | 25 | 40 |

*1: High-cis Polybutadiene rubber (trade name "BR11") available from JSR Co., Ltd.
*The amount of barium sulfate was adjusted to a proper amount such that the weight of the resulting golf ball was 45.4 g.

Preparation of Intermediate Layer Compositions and Cover Compositions

The formulation materials for the intermediate layer and cover shown in Table 2 were mixed using a kneading type twin-screw extruder to obtain pelletized intermediate layer compositions and cover compositions. The extrusion condition was, a screw diameter of 45 mm, a screw speed of 200 rpm, and a screw L/D of 35.

The formulation materials were heated at 200 to 260° C. at the die position of the extruder. The hardness for the intermediate layer ($H_M$) and hardness of the cover were measured, using a sample of a stack of the three or more heat and press molded sheets having a thickness of about 2 mm from the resulting compositions for the intermediate layer and cover, which had been stored at 23° C. for 2 weeks, with a Shore D hardness meter according to ASTM D 2240. The results are shown in Table 2, and Table 3 (Examples) and Table 4 (Comparative Examples). The hardness difference ($H_S$–$H_M$) was determined by calculation from the above values of the hardness, and the result is shown in the same Tables. The test methods are described later.

TABLE 2

(parts by weight)

| Intermediate layer and cover compositions | A | B | C | D | E |
|---|---|---|---|---|---|
| Hi-milan 1605 *2 | 30 | 27.5 | 35 | — | 47.5 |
| Hi-milan 1706 *3 | 30 | 27.5 | 35 | — | 47.5 |
| Elastollan ET880 *4 | — | — | — | 100 | — |
| Rabalon SR04 *5 | 40 | 45 | 30 | — | 5 |
| Titanium dioxide | — | — | — | — | 3 |
| Shore D hardness | 42 | 38 | 49 | 30 | 61 |

*2: Hi-milan 1605 (trade name), ethylene-methacrylic acid copolymer ionomer resin obtained by neutralizing with sodium ion, manufactured by Mitsui Du Pont Polychemical Co., Ltd.
*3: Hi-milan 1706 (trade name), ethylene-methacrylic acid copolymer ionomer resin obtained by neutralizing with zinc ion, manufactured by Mitsui Du Pont Polychemical Co., Ltd.
*4: Elastollan ET880 (trade name), polyurethane-based thermoplastic elastomer, manufactured by BASF Polyurethane Elastomers Ltd.
*5: Rabalon SR04 (trade name), styrene-based thermoplastic elastomer, manufactured by Mitsubishi Chemical Co., Ltd.

Formation of Intermediate Layer

The intermediate layer compositions were covered on the resulting core by injection molding to form an intermediate layer having a thickness shown in Table 3 (Examples) and Table 4 (Comparative Examples).

Examples 1 to 4

Comparative Examples 1 to 6

The cover compositions were covered on the resulting intermediate layer by injection molding using a mold having dimples to form a cover having a thickness shown in Table 3 (Examples) and Table 4 (Comparative Examples). Then, paint was applied on the surface to obtain golf ball having a diameter (D) of 42.70 mm. With respect to the resulting golf balls, the properties of dimple (the number, diameter, depth and volume) were measured. The results are shown in Table 5.

Figure 3:
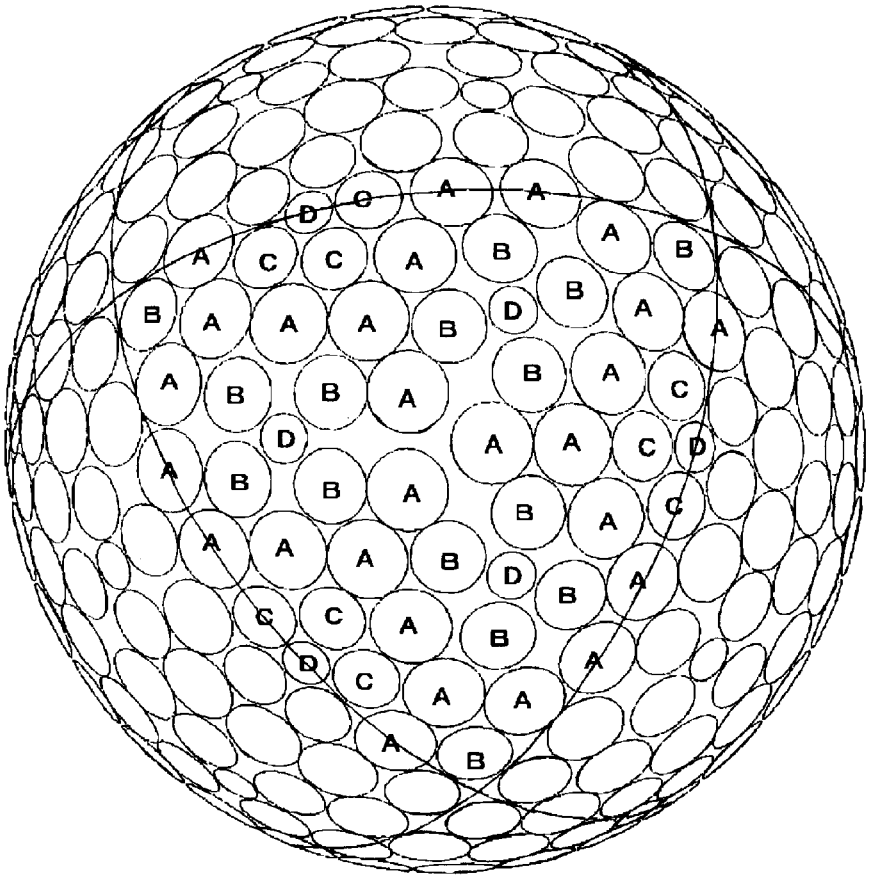
FIG. 3 is a schematic top view (1)-*a* illustrating the arrangement (1) of dimples used in Examples.
Figure 4:
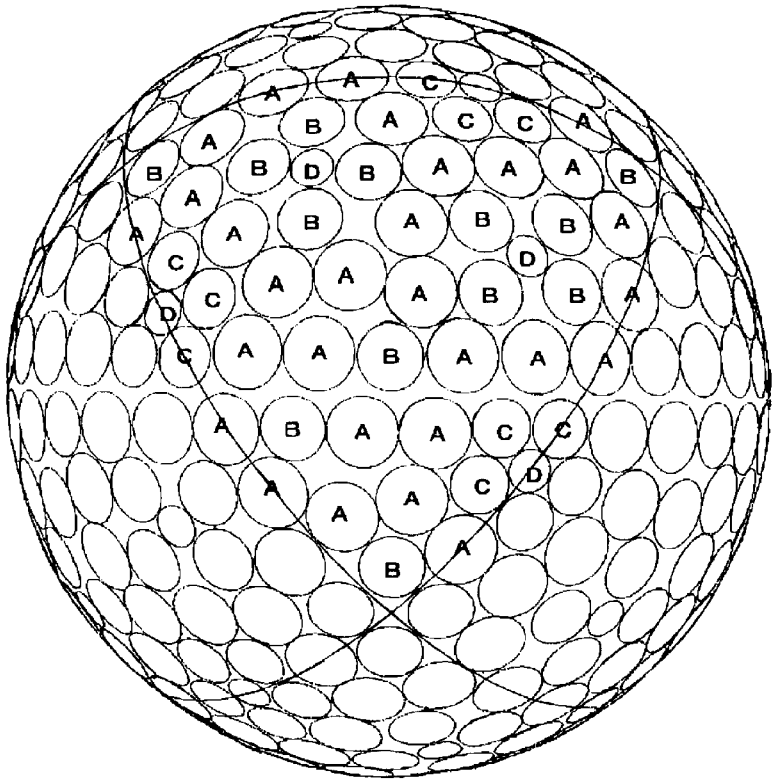
FIG. 4 is a schematic side view (1)-*b* illustrating the arrangement (1) of dimples used in Examples.
Figure 5:
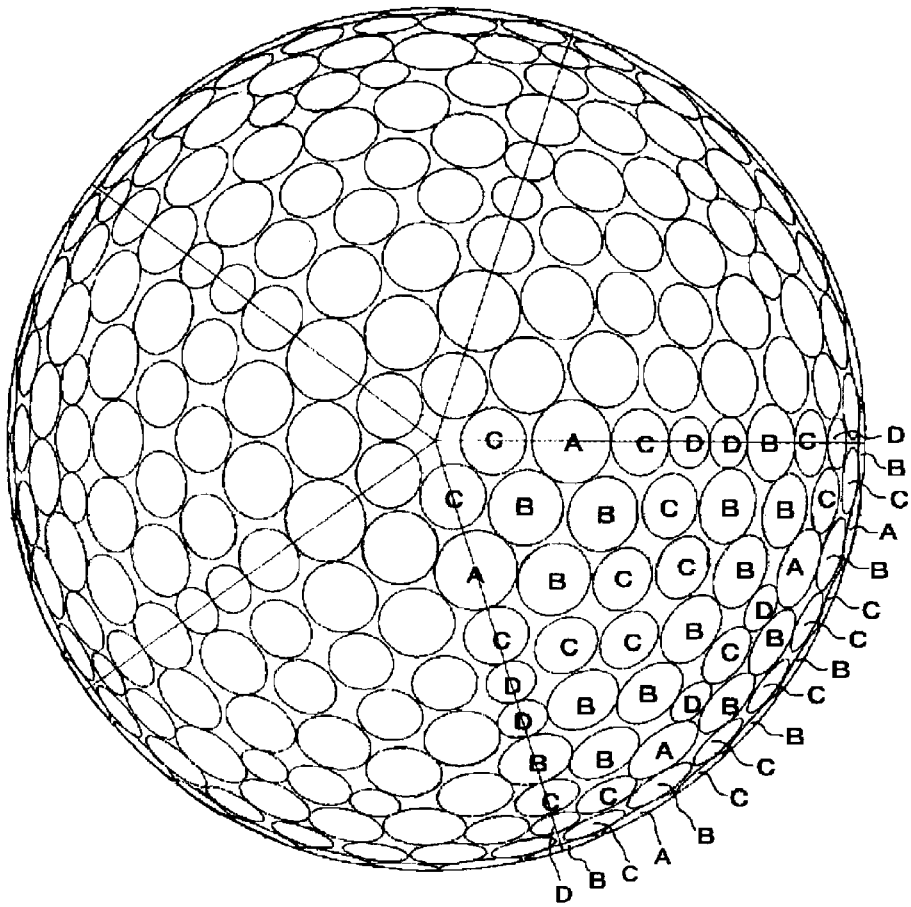
FIG. 5 is a schematic top view (2)-*a* illustrating the arrangement (2) of dimples used in Examples.
Figure 6:
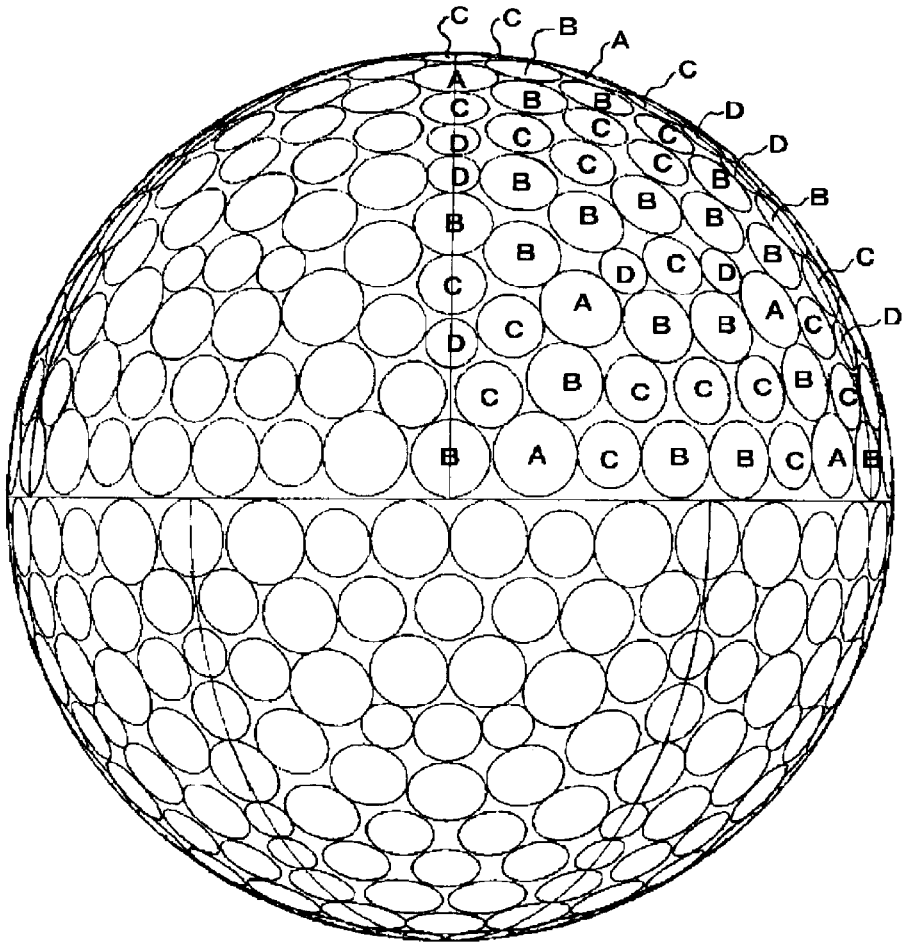
FIG. 6 is a schematic side view (2)-*b* illustrating the arrangement (2) of dimples used in Examples.

The arrangement of the dimples used was of two types, which are (1) and (2), and they are shown in FIG. 3 to FIG. 6. FIG. 3 and FIG. 4 are a schematic top view (1)-*a* and schematic side view (1)-*b* of the arrangement (1) of dimples. FIG. 5 and FIG. 6 are a schematic top view (2)-*a* and schematic side view (2)-*b* of the arrangement (2) of dimples. The arrangements (1) and (2) of the dimples will be explained as follows.

Arrangement (1) of Dimples

The kinds [1] to [4] of the dimples have the same arrangement of dimples, that is, the arrangement (1), which is consisted of 4 types of different dimples A to D (Diameter of dimple: A<B<C<D) and has the total number of 390. The arrangement (1) is a regular octahedron arrangement that the golf ball surface is divided into the same 8 equilateral triangles on spherical surface by partitions, which are shown in FIG. 3 and FIG. 4, but are not actually present on the golf ball.

Arrangement (2) of Dimples

The kind [5] of the dimples has the arrangement (2), which is consisted of 4 types of different dimples A to D (Diameter of dimple: A<B<C<D) and has the total number of 460. The arrangement (2) is an arrangement that a hemispherical surface of the golf ball is divided into 5 equal parts by partitions, which are shown in FIG. 5 and FIG. 6, but are not actually present on the golf ball.

With respect to the resulting golf balls, the coefficient of resilience and flight distance were measured, and the shot feel at the time of hitting was evaluated. The results are shown in Table 6 (Examples) and Table 7 (Comparative Examples). The ratio (Y) of the golf ball surface area occupied by the dimple; the ratio L (=X/D) of the total of a periphery length of the dimple (X) to a diameter of the golf ball (D); and the ratio W ($V_D/V_G$) of the total volume of the dimples ($V_D$) to the volume of the phantom sphere ($V_G$) assuming that the golf ball is a true sphere having no dimples on the surface thereof; were determined by calculation from the above values of the properties of the dimple shown in Table 5, and the results are shown in the same Tables. The test methods are as follows.

(Test Methods)

(1) Hardness (i) Hardness of Core

The surface hardness of the core ($H_S$) was determined by measuring a JIS-C hardness at the surface of the resulting core. The center hardness of the core ($H_C$) was determined by cutting the resulting core into two equal parts and then measuring a JIS-C hardness at its center point in section. The JIS-C hardness was measured using a JIS-C hardness meter according to JIS K6301.

(ii) Hardness of Intermediate Layer and Cover

The hardness of the intermediate layer and cover were determined by measuring a hardness (slab hardness), using a sample of a stack of the three or more heat and press molded sheets having a thickness of about 2 mm from the intermediate layer composition and cover composition, which had been stored at 23° C. for 2 weeks, with a Shore D hardness meter according to ASTM D 2240.

(2) Deformation Amount of Core

The deformation amount of the core was determined by measuring a deformation amount when applying from an initial load of 98 N to a final load of 1275 N on the core.

(3) Coefficient of Resilience

A cylindrical aluminum projectile having weight of 200 g was struck at a speed of 40 m/sec against a golf ball, and the velocity of the projectile and the golf ball after the strike was measured. The coefficient of resilience of the golf ball was calculated from the velocity and the weight of both the projectile and the golf ball before and after the strike. The measurement was conducted by using 12 golf balls for each sample (n=12), with the mean value being taken as the coefficient of resilience of each ball and expressed as an index, with the value of the index in Comparative Example 1 being taken as 1. A higher index corresponded to a higher rebound characteristic, and thus a good result.

(4) Properties of Dimple (i) Total of Periphery Length of Dimple

The total of periphery length of the dimple is the total of the length (x) of a periphery (edge of the dimple) formed on the surface of the golf ball by arranging the dimple. The periphery length of the dimple (x) is determined by the calculation using the following formula:

$$x=d\Pi$$

(wherein "d" refers to a diameter of the dimple).

(ii) Total Volume of Dimple

Figure 2:
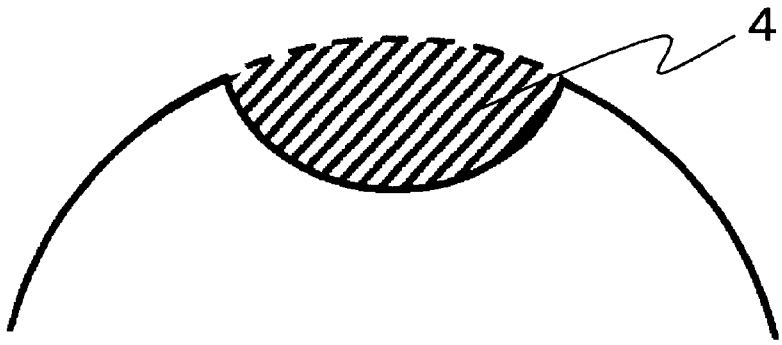
FIG. 2 is a schematic cross section of a dimple of the golf ball of the present invention using for explaining the method of measuring a total volume of the dimples.

The total volume of the dimple is the sum of a volume of each dimple. The volume of each dimple is a volume of a space 4 enclosed by a concave of the dimple and the surface of the phantom sphere assuming that the golf ball is a true sphere having no dimples on the surface thereof, that is, a space corresponding to the portion removed from the golf ball by arranging the dimple on the surface of the golf ball, as described in FIG. 2. The volume of the dimple is determined by measuring a dimple shape in section using a profile meter, and calculating from the shape.

(iii) Ratio of Golf Ball Surface Area Occupied

The ratio of the golf ball surface area occupied by the dimple was determined by obtaining a ratio of (the sum of an area of a spherical surface corresponding to the portion removed from the golf ball by arranging the dimple on the surface of the golf ball) to (the surface area of the golf ball) assuming that the golf ball is a true sphere having no dimples on the surface thereof.

(5) Flight Distance

After a No.1 wood club (W#1, a driver) having a metal head was mounted to a swing robot manufactured by True Temper Co. and the golf ball was hit at a head speed of 40 m/sec, the flight distance was measured. As the flight distance, total that is a distance to the stop point of the hit golf ball was measured. The measurement was conducted 5 times for each golf ball (n=5), and the average is shown as the result of the golf ball.

(6) Shot Feel

The shot feel of the golf ball is evaluated by 10 golfers who swing a golf club at a head speed of not more than 40 m/sec according to a practical hitting test using a No. 1 wood club (W#1, a driver). The evaluation criteria are as follows.

(Evaluation Criteria)

○○: Not less than 8 golfers out of 10 golfers felt that the golf ball has good shot feel such that the impact force at the time of hitting is small.

○: Six to 7 golfers out of 10 golfers felt that the golf ball has good shot feel such that the impact force at the time of hitting is small.

Δ: Four to 5 golfers out of 10 golfers felt that the golf ball has good shot feel such that the impact force at the time of hitting is small.

x: Not more than 3 golfers out of 10 golfers felt that the golf ball has good shot feel such that the impact force at the time of hitting is small.

(Test Results)

TABLE 3

| Test item | Example No. 1 | 2 | 3 | 4 |
|---|---|---|---|---|
| (Core) | | | | |
| Core composition | I | II | I | I |
| Deformation amount (mm) | 4.2 | 4.5 | 4.2 | 4.2 |
| Hardness | | | | |
| Center hardness $H_C$ (JIS-C) | 53 | 49 | 53 | 53 |
| Surface (JIS-C) | 71 | 67 | 71 | 71 |
| hardness $H_S$ (Shore D) | 45 | 42 | 45 | 45 |
| $(H_S - H_C)$ (JIS-C) | 18 | 18 | 18 | 18 |
| (Intermediate layer) | | | | |
| Intermediate layer composition | A | B | A | A |
| Thickness $T_I$ (mm) | 1.8 | 1.7 | 1.8 | 1.8 |
| Hardness $H_M$ (Shore D) | 42 | 38 | 42 | 42 |
| $(H_S - H_M)$ (Shore D) | 3 | 4 | 3 | 3 |
| (Cover) | | | | |
| Cover composition | E | E | E | E |
| Thickness $T_C$ (mm) | 1.6 | 1.7 | 1.6 | 1.6 |
| Hardness (Shore D) | 61 | 61 | 61 | 61 |
| Ratio of thickness $(T_C/T_I)$ | 0.89 | 1.00 | 0.89 | 0.89 |

TABLE 4

| Test item | Comparative Example No. 1 | 2 | 3 | 4 | 5 | 6 |
|---|---|---|---|---|---|---|
| (Core) | | | | | | |
| Core composition | I | I | III | II | I | I |
| Deformation amount (mm) | 4.2 | 4.2 | 4.1 | 4.5 | 4.2 | 4.2 |

TABLE 4-continued

| Test item | Comparative Example No. 1 | 2 | 3 | 4 | 5 | 6 |
|---|---|---|---|---|---|---|
| Hardness | | | | | | |
| Center hardness $H_C$ (JIS-C) | 53 | 53 | 57 | 49 | 53 | 53 |
| Surface (JIS-C) | 71 | 71 | 63 | 67 | 71 | 71 |
| Hardness $H_S$ (Shore D) | 45 | 45 | 39 | 42 | 45 | 45 |
| $(H_S - H_C)$ (JIS-C) | 18 | 18 | 6 | 18 | 18 | 18 |
| (Intermediate layer) | | | | | | |
| Intermediate layer composition | D | B | B | C | A | A |
| Thickness $T_I$ (mm) | 1.8 | 1.5 | 1.8 | 1.8 | 1.8 | 1.8 |
| Hardness $H_M$ (Shore D) | 30 | 38 | 38 | 49 | 42 | 42 |
| $(H_S - H_M)$ (Shore D) | 15 | 7 | 1 | −7 | 3 | 3 |
| (Cover) | | | | | | |
| Cover composition | E | E | E | E | E | E |
| Thickness $T_C$ (mm) | 1.6 | 1.9 | 1.6 | 1.6 | 1.6 | 1.6 |
| Hardness (Shore D) | 61 | 61 | 61 | 61 | 61 | 61 |
| Ratio of thickness $(T_C/T_I)$ | 0.89 | 1.26 | 0.89 | 0.89 | 0.89 | 0.89 |

TABLE 5

| Kind | Arrangement | Pattern | n | N | d (mm) | Depth (mm) | Volume (mm) |
|---|---|---|---|---|---|---|---|
| [1] | (1) | A | 186 | 390 | 4.085 | 0.2340 | 1.535 |
| | | B | 114 | | 3.815 | 0.2198 | 1.258 |
| | | C | 60 | | 3.450 | 0.2047 | 0.958 |
| | | D | 30 | | 2.600 | 0.1730 | 0.461 |
| [2] | (1) | A | 186 | 390 | 4.210 | 0.2129 | 1.483 |
| | | B | 114 | | 3.975 | 0.1969 | 1.223 |
| | | C | 60 | | 3.610 | 0.1854 | 0.950 |
| | | D | 30 | | 2.625 | 0.1488 | 0.403 |
| [3] | (1) | A | 186 | 390 | 3.950 | 0.2663 | 1.635 |
| | | B | 114 | | 3.700 | 0.2529 | 1.363 |
| | | C | 60 | | 3.300 | 0.2359 | 1.011 |
| | | D | 30 | | 2.300 | 0.1999 | 0.418 |
| [4] | (1) | A | 186 | 390 | 4.200 | 0.2564 | 1.779 |
| | | B | 114 | | 3.950 | 0.2424 | 1.488 |
| | | C | 60 | | 3.600 | 0.2276 | 1.161 |
| | | D | 30 | | 2.600 | 0.1821 | 0.485 |
| [5] | (2) | A | 50 | 460 | 4.150 | 0.2453 | 1.661 |
| | | B | 180 | | 3.850 | 0.2303 | 1.342 |
| | | C | 180 | | 3.300 | 0.2009 | 0.861 |
| | | D | 50 | | 2.550 | 0.1751 | 0.449 |

d: diameter of dimple
n: number of dimples
N: total number of dimples

TABLE 6

| Test item | Example No. 1 | 2 | 3 | 4 |
|---|---|---|---|---|
| (Properties of dimple) | | | | |
| Kind | [1] | [1] | [3] | [2] |
| Y (mm) | 0.780 | 0.780 | 0.725 | 0.836 |
| Ratio L | 108.9 | 108.9 | 104.7 | 112.7 |
| Ratio W | 0.0123 | 0.0123 | 0.0131 | 0.0119 |
| (Physical properties of golf ball) | | | | |
| Coefficient of resilience | 1.02 | 1.01 | 1.02 | 1.02 |
| Flight distance (m) | 193.5 | 193.0 | 193.0 | 192.5 |
| Shot feel | ○○ | ○○ | ○○ | ○○ |

TABLE 7

| Test item | Comparative Example No. 1 | 2 | 3 | 4 | 5 | 6 |
|---|---|---|---|---|---|---|
| (Properties of dimple) | | | | | | |
| Kind | [1] | [1] | [1] | [1] | [4] | [5] |
| Y (mm) | 0.780 | 0.780 | 0.780 | 0.780 | 0.830 | 0.799 |
| Ratio L | 108.9 | 108.9 | 108.9 | 108.9 | 112.2 | 119.3 |
| Ratio W | 0.0123 | 0.0123 | 0.0123 | 0.0123 | 0.0143 | 0.0123 |
| (Physical properties of golf ball) | | | | | | |
| Coefficient of resilience | 1 | 1.01 | 1.02 | 1.02 | 1.02 | 1.02 |
| Flight distance (m) | 192.0 | 192.5 | 193.0 | 193.5 | 191.0 | 192.0 |
| Shot feel | ○○ | Δ | Δ | x | ○○ | ○○ |

As is apparent from Tables 6 to 7, the golf balls of Examples 1 to 4 of the present invention, when compared with the golf balls of Comparative Examples 1 to 6, have soft and good shot feel and excellent flight performance when hit by a golfer who swings a golf club at low head speed.

On the other hand, in the golf ball of Comparative Example 1, since the hardness of the intermediate layer is low, the rebound characteristics are degraded, which degrades the flight performance. In the golf ball of Comparative Example 2, since the ratio ($T_C/T_I$) of the thickness of the cover ($T_C$) to that of the intermediate layer ($T_I$) is large, the shot feel is poor.

In the golf ball of Comparative Example 3, since the hardness difference ($H_S-H_C$) in the core is too small, the deformation amount at the time of hitting is small, and the shot feel is poor. In the golf ball of Comparative Example 4, since the hardness of the intermediate layer is higher than the surface hardness of the core, the resulting golf ball is too hard and is difficult to deform, and the shot feel is hard and poor.

In the golf ball of Comparative Example 5, since the ratio W ($=V_D/V_G$) is large, a balance between lifting power and drag is lost, and the hit golf ball has low trajectory, which reduces the flight distance. In the golf ball of Comparative Example 6, since the ratio L (=X/D) is large, large changing of airflow around the golf ball on the fly excessively occurs to break symmetry of the airflow on the fly, which reduces the flight distance.

What is claimed is:

1. A multi-piece solid golf ball comprising a core, at least one of an intermediate layer formed on the core and a cover covering the intermediate layer and having many dimples on the surface thereof, wherein a hardness difference in JIS-C hardness ($H_S-H_C$) between a surface hardness ($H_S$) and a center hardness ($H_C$) of the core is larger than 10, a hardness of the intermediate layer is lower than the surface hardness of the core, and the hardness in Shore D hardness of the intermediate layer is higher than 35, a ratio ($T_C/T_I$) of a thickness of the cover ($T_C$) to that of the intermediate layer adjacent to the cover ($T_I$) is larger than 0.7 and smaller than 1.2, a ratio (X/D) of the total of a periphery length of the dimple (X) to a diameter of the golf ball (D) is within the range of 90.0 to 118.0, wherein a base resin of the intermediate layer comprises an inomer resin as a main component, and comprises 5 to 50 parts by weight of a thermoplastic elastomer, based on 100 parts by weight of the base resin for the intermediate layer, and a ratio ($V_D/V_G$) of the total volume of the dimples ($V_D$) to a volume of the phantom sphere ($V_G$) assuming that the golf ball is a true sphere having no dimples on the surface thereof is within the range of 0.0108 to 0.0142.

2. The multi-piece solid golf ball according to claim 1, wherein the cover has a hardness in Shore D hardness of higher than 55.

3. The multi-piece solid golf ball according to claim 1, wherein the dimples have a ratio of the golf ball surface area occupied by the dimple to the total surface area of the golf ball of 0.7 to 0.9.

4. The multi-piece solid golf ball according to claim 1, wherein the dimples have a total number of 300 to 500.

* * * * *